United States Patent [19]

Sinnott et al.

[11] 3,995,147

[45] Nov. 30, 1976

[54] PHOTOGRAPHIC COMPOSITION SYSTEM USING A FONT STRIP HAVING A NON-UNIFORM CHARACTER DISTRIBUTION

[75] Inventors: David J. Sinnott, Ringwood; Donald E. Alecci, Pine Brook, both of N.J.

[73] Assignee: Star-New Era, Inc., South Hackensack, N.J.

[22] Filed: Feb. 9, 1971

[21] Appl. No.: 113,965

[52] U.S. Cl. ..... 235/151.22; 354/5

[51] Int. Cl.[2] ..... B41B 25/00

[58] Field of Search ..... 235/151.22; 95/4.5; 197/6.6, 9

[56] References Cited

UNITED STATES PATENTS

| | | | |
|---|---|---|---|
| 3,227,258 | 1/1966 | Pannier et al. | 197/6.6 |
| 3,336,849 | 8/1967 | Broglio | 95/4.5 |
| 3,357,327 | 12/1967 | Proud, Jr. | 95/4.5 |
| 3,529,521 | 9/1970 | Astley | 95/4.5 |
| 3,543,657 | 12/1970 | Rosenblum | 95/4.5 |
| 3,568,580 | 3/1971 | Moyroud | 95/4.5 |
| 3,581,632 | 6/1971 | Gatter | 95/4.5 |

*Primary Examiner*—Edward J. Wise

[57] ABSTRACT

An improved photographic composition system utilizes a pulsed light source which projects a beam of light through a character outline on a font strip to produce an image which is reflected by a mirror onto a light sensitive sheet. The font strip character distribution is based on three factors: first is the frequency of occurrence of each character, second is the frequency of occurrence of adjacent characters, and third is the rotational speed of the drum which carries the font strip.

1 Claim, 4 Drawing Figures

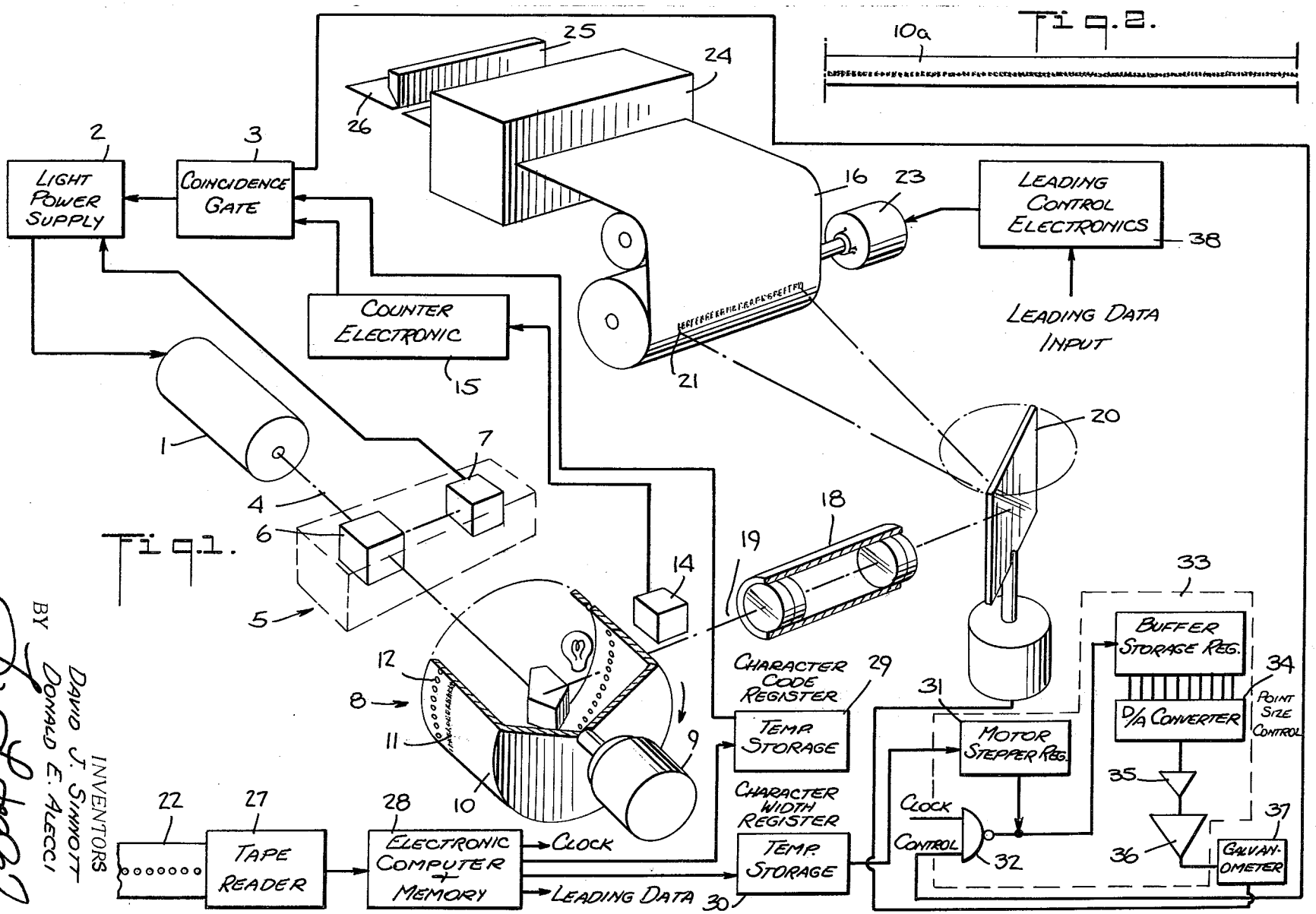
INVENTORS
DAVID J. SINNOTT
DONALD E. ALECCI
BY
ATTORNEY

INVENTORS
DAVID J. SINNOTT
BY DONALD E. ALECCI
ATTORNEY

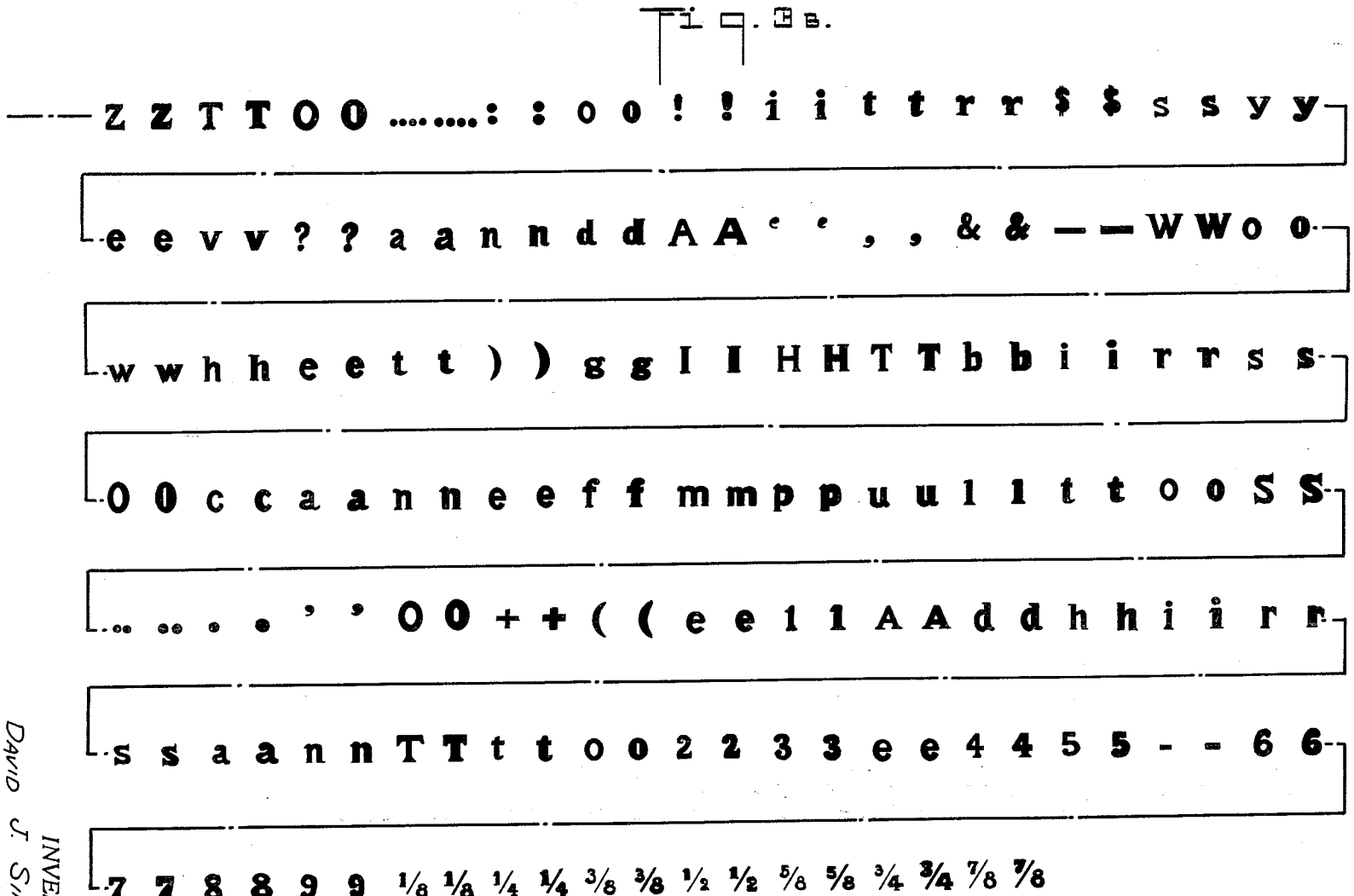
INVENTORS
DAVID J. SINNOTT
BY DONALD E. ALECCI
ATTORNEY

PHOTOGRAPHIC COMPOSITION SYSTEM USING A FONT STRIP HAVING A NON-UNIFORM CHARACTER DISTRIBUTION

This invention relates to typesetting and composition of printed matter and in particular to an improved phototype composition and type preparation system and mechanism for the preparation system and mechanism for the preparation of proof copy and printing plates for offset, letter and lithographic presses, as described in the application Photographic Composition System Ser. No. 825,692 filed May 19, 1969 now patent no. 3,710,698. Such equipment operates by taking a punched tape input, which may be prepared on any tape perforator now commonly used, and converting the data into a photo-composition which is fully justified.

Photocomposing machines are well known in the art. In some machines, cut stencils were interposed between a light source and light sensitive paper for film, and the paper or film was progressively moved for proper alignment and spacing of the characters. The production rate of these machines was necessarily low and required a high degree of skill from the operator.

In other machines the stencils were placed on rotary plates, strips, or drums to form a character created by a light source. These characters were progressively placed on film or paper by a translating prism-mirror optical system to create a line type. Obviously, the speed of such machines was limited by the light source and the translating means of placement of each character on the film or paper.

The principal object of this invention is an improved photocomposition machine that will prepare a more rapid typesetting copy and film for preparation of printing plates or finished printed material at speeds compatible both with the present requirements of the graphic arts and the skills now available in any newspaper, book publisher or print shop.

A tape of the textual material to be composed is placed into a tape reader which reads the tape as to the character and line data. The data is entered into a computer which transforms the character data to a "count" which identifies the position of the character on a drum (commonly called a font strip) and which controls the occurrence of a light flash through the drum which has character efformations. The computer also generates a digital code for the orientation of a mirror for reflecting the light subsequently onto a photo-sensitive material.

The physical orientation of the mirror is accomplished through the improvement comprising a coincidence control and a galvanometer movement. A digital-to-analog converter for generating the analog voltage input to the galvanometer rotates the mirror only when the coincidence control indicates rotation will not interfere with imprinting the photosensitive material. A gain control on the digital-to-analog converter permits a simple adjustment for adapting the photocomposition system for various character point sizes.

The present invention is directed to an improved font strip having a predetermined non-uniform distribution of characters.

Another object of the present invention is to provide a font strip character distribution which corresponds to the frequency of occurrence of characters in usage.

Another object of this invention is to provide a font strip character distribution in which character pairs which frequently occur in textual material are distributed on the font strip so as to facilitate rapid imprinting of these characters.

Another object of this invention is to provide a font strip character distribution which includes more than one font or character style.

A further object of this invention is to provide a font strip distribution which accounts for the rapidity with which a character can be selected by input signals.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for purposes of illustration and description and is shown in the accompanying drawing, forming a part of the specification wherein:

FIG. 1 is a diagram of the improved photocomposition system;

FIG. 2 is a plan view of a circular font plate spread out; and

FIGS. 3A and 3B illustrate the preferred embodiment of the font strip.

FIG. 1 illustrates, with blocks of sub-systems and perspective views of hardware, the preferred embodiment of the present invention.

Figure 3A:
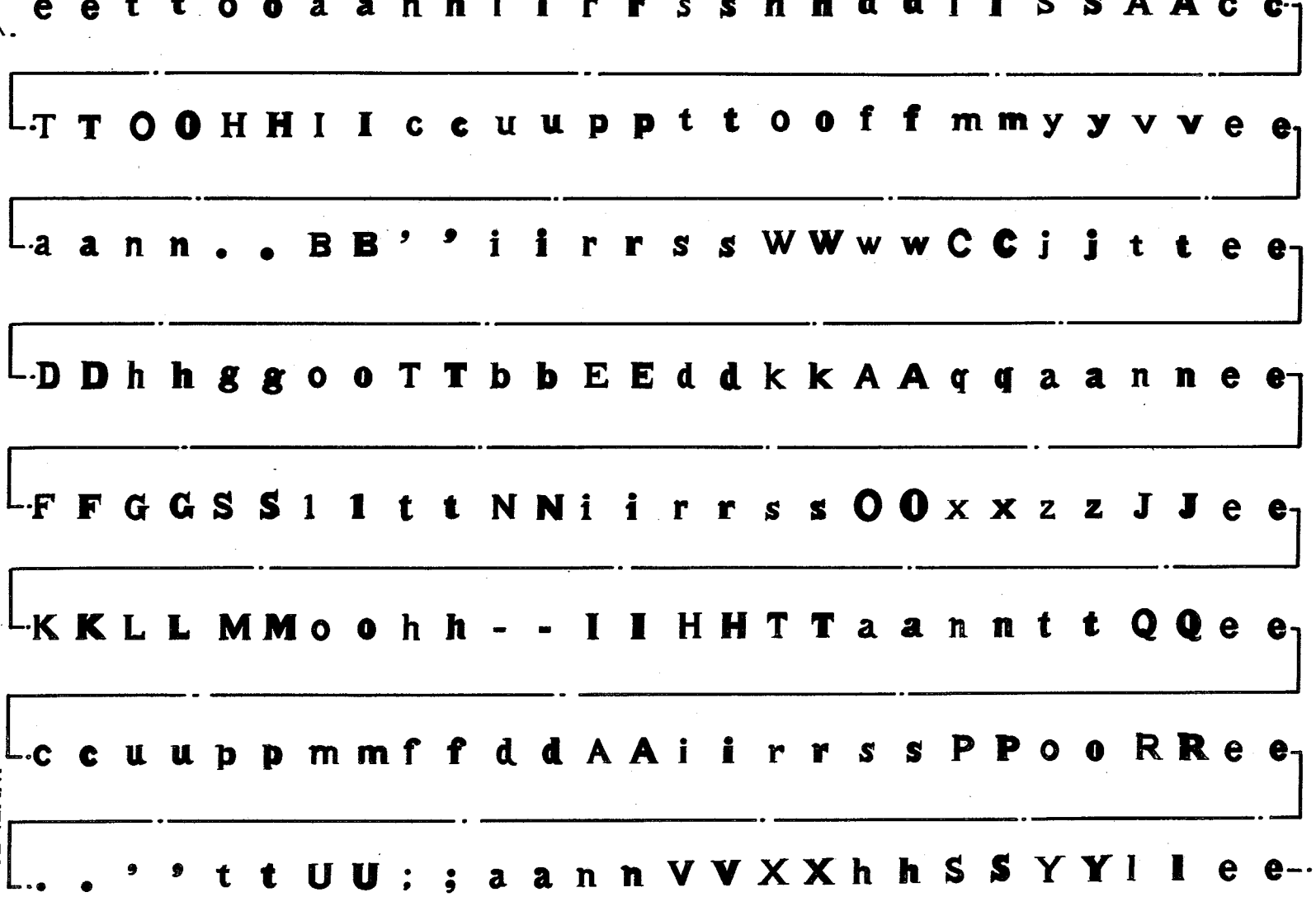

Light source 1 is powered by light power supply in response to a signal from coincidence gate 3. Light source 1 is selected to provide an intense, short burst of light 4. Light source 1 can be any controllable light source such as a zeon flash tube or even a laser.

Light 4 passes through monitor 5 which samples and detects a portion of light 4. Beam splitter 6 deflects a portion of light 4 to light detector 7 while the remainder of light 4 continues on to drum assembly 8. Light detector 7 transforms incident light to an electrical signal which is fed into the light power supply 2 so as to maintain a predetermined light output intensity from light source 1.

Drum assembly 8 is comprised of a drive motor 9 which rotates drum 10 continuously. Drum 10 has a mask or font strip **10*a* which has a group of transparent alphanumerics 11 (commonly called a font) and a group of corresponding transparent apertures 12. A detailed description of font strip 10*a* will be given after the mode of operation of the system shown in FIG. 1** has been described.

Light source 13 is simple source of light for illuminating light detector 14 each time an aperture 12 passes between light source 13 and light detector 14. Each time light detector 14 is illuminated an electrical pulse is coupled to counter electronics 15. The numerical count in counter electronics 15 identifies the alphanumeric 11 which is in position for being impressed on photo-sensitive material 16 as will be described in detail.

Counter electronics 15 accumulates electrical pulses until the count is "full" at which point all alphanumerics 11 on drum 10 have been in position for being impressed on photosensitive material 16. Counter electronics 15 then resets so as to start the count from zero. No alphanumeric 11 can be impressed during the reset time. The initial count after reset must always start with the same alphanumeric 11 in order to maintain the equivalence between the numerical count and the alphanumerics 11.

The light 4 which has passed through monitor 5 continues to reflecting mechanism 17 which is shown as a penta-reflector where the light 4 is reflected through the desired alphanumeric 11. The lens system 18 projects the optical image 19 of alphanumeric 11 on reflector 20 which reflects the optical image 19 to the photosensitive material 16.

The orientation of reflector 20 determines the position of the impressed optical image 19 on photosensitive material 16. Reflector 20 is controlled by the electronics shown in block diagram form and which will be described herein.

The distance between reflector 20 and photosensitive material 16 is made large enough so that perceptible distortion of the impressed optical image 19 does not occur for various parts of photosensitive material 16. If it is necessary to make the distance between reflector 20 and photosensitive material 16 small, distortion can be avoided, either by curving photosensitive material 16 so that the alphanumeric line 21 is equidistant from reflector 20, or by using an appropriate optical lens system.

At the completion of alphanumeric line 21 in accordance with data encoded on tape 22, mechanism 23 moves the photosensitive material 16 up for the next alphanumeric line 21. Developer 24 processes and develops photosensitive material 16 and then cutter 25 cuts strips 26 for storage and future use.

Having described the general operation of the preferred embodiment, now the relationship between the input tape 22 and the various electronics will be described.

Encoded on tape 22 is data specifying alphanumerics 11 and the completion of alphanumeric line 21. Tape 22 is decoded by tape reader 27 and the decoded data is coupled to electronic computer and memory 28.

Computer 28 is programmed to take the alphanumeric data from tape reader 27 and generate a count number for character code register 29 and a width number for character width register 30. The character code register 29 temporarily stores the data and couples it to coincident gate 3. When the counter electronics 15 input to coincidence gate 3 is the same as the count number from the character code register 29, the specified alphanumeric 11 is in position for impressing it on photosensitive material 16.

The data in the character width register 30 is transferred to the motor stepper register 31 where the data is stored until the coincidence gate 3 outputs a pulse to NAND gate 32 so as to gate the clock pulse input through gate 32. The clock pulse input transfers the digital data from register 31 to buffer storage register 33.

Digital-to-analog converter 34 transforms the digital data in register 33 to an analog signal. The converter 34 has a control input which permits the analog gain to be adjusted to conform with the alphanumeric point size base. The digital data may be the same whereas the alphanumeric sizes may be different. Amplifiers 35 and 36 amplify the analog signal form converter 34.

The amplified signal from amplifier 36 is coupled to galvanometer 37 which rotates reflector 20 so that the next alphanumeric 11 specified by tape 22 will be impressed in the proper position on photosensitive material 16 in accordance with the size of the alphanumeric 11 last impressed.

A justified tape 22 will provide a code to computer 28 to indicate the completion of a line 21 otherwise the computer 28 will conclude that a line 21 is "full". In either event, computer 28 outputs a leading data input to leading control electronics 38 so that a signal is provided for drive 23 for moving photosensitive material 16 to expose the next line 21.

FIGS. 3A and 3B show the characters which are on the rotating font drum 10 and which are shown diagrammatically in FIG. 2 as being in a line.

FIGS. 3A and 3B illustrate the distribution of characters for a preferred embodiment of the font strip 10*a* (FIG. 2). The characters actually appear as transparent portions on an opaque strip which would be wound around the font drum 10 and which are shown spread out in FIG. 2. The alphanumerics would appear in continuous line about the drum. There are actually two font styles shown in FIGS. 3A and B, one style being ordinary font and the other style being bold face type. Each alphanumeric 11 in the ordinary type style is followed by an alphanumeric 11 in the bold font style.

The position of each alphanumeric 11 is in correspondence with a number starting with position one for "*e*" in ordinary type style (shown in the upper left-hand corner of FIG. 3A) and continuing up in consecutive order; the last alphanumeric is "seven-eighths" which is in bold font style and is in position 399.

The basis for the selection of the frequency of occurrence and position of the alphanumerics 11 on the font strip 10*a* is related to a study made of typical textual material for which the font strip 10*a* will be used. The actual study of the textual material is made in the following manner. A sheet of paper is prepared with columns corresponding to each of the alphanumerics 11 which will be used on font strip 10*a* and columns are set aside in correspondence to alphanumeric pairs which are known to occur frequently. Next, a selection of pages from typical textual material is made. This selection should be made at random. Then, a count of the number of occurrences of each alphanumeric and alphanumeric pair is made for the material selected and entered on the prepared sheet.

This table of data represents the distribution factor to be used in preparing font strip 10*a*. In order to simplify the interpretation of the prepared data, it is desireable to normalize all of the numerical values with respect to the numerical value corresponding to the least occurring alphanumeric. Naturally, there is a possibility that certain alphanumerics such as "$" might not appear in the selection of textual material so that normalization would, of course, be for some alphanumeric which has had at least one occurrence in the selected material.

Now it might happen that the distribution of alphanumerics is greatly distorted due to an unusually high occurrence of, say, the other "*e*". Some judgment must be given as to the accommodation of the unusual high occurrence of very few alphanumerics and the non-occurrence of certain alphanumerics.

In addition to considering actual occurrences of alphanumerics and alphanumeric pairs in textual material, further consideration must be given to the actual size of the font strip 10*a* and the number of font types which will be represented on font strip 10*a*.

A typical study of textual material indicates that the character "*t*" occurs approximately five times more often than the character "*b*". Also, the character "*b*" occurs about twice as often as the character "*k*". Table 1 presents the alphanumeric distribution corresponding to the distribution used on font strip 10*a* in the preferred embodiment. The ratios of the total number of occurrences of alphanumerics in Table 1 corresponds to the approximate frequency of occurrences of the alphanumerics in a sampling of typical textual material. As it was mentioned above, the final selection for the occurrence of alphanumerics 11 on font strip 10*a* must take into account the necessity for including uncommon alphanumerics.

TABLE I

| Alphanumeric | Alphanumeric Position | Total Used |
|---|---|---|
| a | 7, 57, 107, 159, 207, 257, 307, 357. | 8 |
| b | 95, 295. | 2 |
| c | 37, 169, 305. | 3 |
| d | 19, 99, 179, 261, 347. | 5 |
| e | 1, 27, 55, 83, 111, 139, 167, 195, 223, 251, 281, 311, 341, 371. | 14 |
| f | 47, 177, 313. | 3 |
| g | 89, 287. | 2 |
| h | 17, 87, 149, 215, 279, 349. | 6 |
| i | 11, 67, 125, 183, 239, 297, 351. | 7 |
| j | 79 | 1 |
| k | 101 | 1 |
| l | 21, 119, 221, 321. | 4 |
| m | 49, 175, 315. | 3 |
| n | 9, 59, 109, 161, 209, 259, 309, 359. | 8 |
| o | 5, 45, 91, 147, 191, 235, 275, 325, 365. | 9 |
| p | 41, 173, 317. | 3 |
| q | 105. | 1 |
| r | 13, 69, 127, 185, 243, 299, 353, | 7 |
| s | 15, 71, 129, 187, 247, 301, 355. | 7 |
| t | 3, 43, 81, 121, 163, 201, 241, 283, 323, 363 | 10 |
| u | 39, 171, 319. | 3 |
| v | 53, 253. | 2 |
| w | 75, 277. | 2 |
| x | 133. | 1 |
| y | 51, 249. | 2 |
| z | 135. | 1 |
| A | 25, 103, 181, 263, 345. | 5 |
| B | 63. | 1 |
| C | 77. | 1 |
| D | 85. | 1 |
| E | 97. | 1 |
| F | 113. | 1 |
| G | 115. | 1 |
| H | 33, 155, 291. | 3 |
| I | 35, 153, 289. | 3 |
| J | 137. | 1 |
| K | 141. | 1 |
| L | 143. | 1 |
| M | 145. | 1 |
| N | 123. | 1 |
| O | 31, 131, 229, 335. | 4 |
| P | 189. | 1 |
| Q | 165. | 1 |
| R | 193. | 1 |
| S | 23, 117, 217, 327. | 4 |
| T | 29, 93, 157, 227, 293, 361. | 6 |
| U | 203. | 1 |
| V | 211. | 1 |
| W | 73, 273. | 2 |
| X | 213. | 1 |
| Y | 219. | 1 |
| Z | 225. | 1 |
| - (En Leader) | 329. | 1 |
| —(Long Dash) | 271. | 1 |
| $ (Dollar Sign) | 245. | 1 |
| . (Period) | 61, 197, 331. | 3 |
| , (Comma) | 65, 199, 333. | 3 |
| . . . (Em Leader) | 231. | 1 |
| : (Colon) | 233. | 1 |
| ; (Semi-Colon) | 205. | 1 |
| ! (Exclamation Point) | 237. | 1 |
| ? (Question Mark) | 255. | 1 |
| ' (Quote) | 265. | 1 |
| ' (Quote) | 267. | 1 |
| & (Ampersand) | 269. | 1 |
| ( (Parenthesis) | 339. | 1 |
| ) (Parenthesis) | 285. | 1 |
| + (Plus) | 337. | 1 |
| - (Hyphen) | 151, 377. | 2 |
| 0 (Zero) | 303. | 1 |
| 1 (One) | 343. | 1 |
| 2 | 367. | 1 |

TABLE I-continued

| Alphanumeric | Alphanumeric Position | Total Used |
|---|---|---|
| 3 | 369. | 1 |
| 4 | 373. | 1 |
| 5 | 375. | 1 |
| 6 | 379. | 1 |
| 7 | 381. | 1 |
| 8 | 383. | 1 |
| 9 | 385. | 1 |
| ⅛ | 387. | 1 |
| ¼ | 389. | 1 |
| ⅜ | 391. | 1 |
| ½ | 393. | 1 |
| ⅝ | 395. | 1 |
| ¾ | 397. | 1 |
| ⅞ | 399. | 1 |

In Table 1, it can be seen that the positions of the alphanumeric 11 are all specified by odd numbers. These 'odd numbers' refer to ordinary font type, whereas the even numbers, not given, relate to bold face font type which occur immediately following the corresponding ordinary font type alphanumeric 11.

The distribution of, say, character "*a*" on font strip 10*a* must conform to a desire to minimize access time, that is, the time to "call up" an alphanumeric 11 from an input code, and an attempt to separate "*a*" from a commonly occurring alphanumeric companion, that is, an alphanumeric which occurs with "*a*" often in textual material. The simplest approach to distributing the character "*a*" on font strip 10*a* is to evenly distribute the characters "*a*". The eight occurrences of "*a*" on font strip 10*a* occupy positions 7, 57, 107, 159, 207, 257, 307 and 357 as indicated in Table I. This distribution implies that drum 10 would have to rotate a maximum of about one-eighth of a revolution in order to select two adjacent characters "*a*" for imprinting. The distribution of other alphanumeric 11 are based on the same principle that a uniform distribution of occurrences on font strip 10*a* minimizes the maximum acquisition time between the selection of two adjacent alphanumerics for imprinting.

In preparing a table on the occurrences of alphanumerics in typical textual material, an accounting was made for frequently occurring pairs of alphanumerics and this factor should be reflected in the preferred font strip alphanumeric distribution. If, for example, textual material indicated that "*a*" follows "*e*" a very great number of times, then it is more desirable to have "*e*" and "*a*" separated on the font strip 10*a* by a space which permits the acquisition of the first "*a*" following an "*e*". However, there are then two factors guiding the preparation of font strip 10*a* which are, in a sense, in opposition and conflict. The characters "e" and "a" occur in textual material and on font strip 10*a* unequal times, in particular, 14 and 8 occurrences respectively on font strip 10*a*. The uniform distribution of characters "*e*" and "*a*" on font strip 10*a* cannot maintain a satisfactory acquisition time between each "*a*" following an "*e*". In the preferred embodiment shown in FIGS. 3A and 3B, the desire to uniformly distribute alphanumeric 11 on font strip 10*a* has dominated over the full consideration of acquisition time between commonly occurring alphanumeric pairs. An alternate embodiment in which the separation between common character pairs has been considered with greater weight is not shown, but it is evident from the foregoing as to the manner such a distribution would be prepared.

It is evident that the present invention provides an improved photocomposing machine which will prepare a rapid typesetting copy and film for preparation of printing plates at speeds which are compatible with present day requirements.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

It is claimed:

1. A movable character carrier for a photocomposing machine, comprising a series of alphanumeric characters, each character having a predetermined position on said character carrier, the position of said characters on said character carrier being designated numerically and each character being positioned in accordance with the following table:

| Character | Position | Total Used |
|---|---|---|
| a | 7, 57, 107, 159, 207, 257, 307, 357. | 8 |
| b | 95, 295. | 2 |
| c | 37, 169, 305. | 3 |
| d | 19, 99, 179, 261, 347. | 5 |
| e | 1, 27, 83, 111, 139, 167, 195, 223, 251, 281, 311, 341, 371. | 14 |
| f | 47, 177, 313. | 3 |
| g | 89, 287. | 2 |
| h | 17, 87, 149, 215, 279, 349. | 6 |
| i | 11, 67, 125, 183, 239, 297, 351. | 7 |
| j | 79 | 1 |
| k | 101 | 1 |
| l | 21, 119, 221, 321. | 4 |
| m | 49, 175, 315. | 3 |
| n | 9, 59, 109, 161, 209, 259, 309, 359. | 8 |
| o | 5, 45, 91, 147, 191, 235, 275, 325, 365. | 9 |
| p | 41, 173, 317. | 3 |
| q | 105. | 1 |
| r | 13, 69, 127, 185, 243, 299, 353, | 7 |
| s | 15, 71, 129, 187, 247, 301, 355. | 7 |
| t | 3, 43, 81, 121, 163, 201, 241, 283, 323, 363 | 10 |
| u | 39, 171, 319. | 3 |
| v | 53, 253. | 2 |
| w | 75, 277. | 2 |
| x | 133. | 1 |
| y | 51, 249. | 2 |

-continued

| Character | Position | Total Used |
|---|---|---|
| z | 135. | 1 |
| A | 25, 103, 181, 263, 345. | 5 |
| B | 63. | 1 |
| C | 77. | 1 |
| D | 85. | 1 |
| E | 97. | 1 |
| F | 113. | 1 |
| G | 115. | 1 |
| H | 33, 155, 291. | 3 |
| I | 35, 153, 289. | 3 |
| J | 137. | 1 |
| K | 141. | 1 |
| L | 143. | 1 |
| M | 145. | 1 |
| N | 123. | 1 |
| O | 31, 131, 229, 335. | 4 |
| P | 189. | 1 |
| Q | 165. | 1 |
| R | 193. | 1 |
| S | 23, 117, 217, 327. | 4 |
| T | 29, 93, 157, 227, 293, 361. | 6 |
| U | 203. | 1 |
| V | 211. | 1 |
| W | 73, 273. | 2 |
| X | 213. | 1 |
| Y | 219. | 1 |
| Z | 225. | 1 |
| - (En Leader) | 329. | 1 |
| — (Long Dash) | 271. | 1 |
| $ (Dollar Sign) | 245. | 1 |
| . (Period) | 61, 197, 331. | 3 |
| , (Comma) | 65, 199, 333. | 3 |
| . . . (Em Leader) | 231. | 1 |
| : (Colon) | 233. | 1 |
| ; (Semi-Colon) | 205. | 1 |
| ! (Exclamation Point) | 237. | 1 |
| ? (Question Mark) | 255. | 1 |
| ‘ (Quote) | 265. | 1 |
| ’ (Quote) | 267. | 1 |
| & (Ampersand) | 269. | 1 |
| ( (Parenthesis) | 339. | 1 |
| ) (Parenthesis) | 285. | 1 |
| + (Plus) | 337. | 1 |
| - (Hyphen) | 151, 377. | 2 |
| 0 (Zero) | 303. | 1 |
| 1 (One) | 343. | 1 |
| 2 | 367. | 1 |
| 3 | 369. | 1 |
| 4 | 373. | 1 |
| 5 | 375. | 1 |
| 6 | 379. | 1 |
| 7 | 381. | 1 |
| 8 | 383. | 1 |
| 9 | 385. | 1 |
| ⅛ | 387. | 1 |
| ¼ | 389. | 1 |
| ⅜ | 391. | 1 |
| ½ | 393. | 1 |
| ⅝ | 395. | 1 |
| ¾ | 397. | 1 |
| ⅞ | 399. | 1 |

* * * * *